US007144140B2

(12) United States Patent
Sun et al.

(10) Patent No.: US 7,144,140 B2
(45) Date of Patent: Dec. 5, 2006

(54) HEAT DISSIPATING APPARATUS FOR LIGHTING UTILITY

(76) Inventors: Tsung-Ting Sun, 4F, No. 800, Chung-Cheng Rd., Chung-Ho City, Taipei (TW); Cheng-Hung Tsai, 4F, No. 800, Chung-Cheng Rd., Chung-Ho City, Taipei (TW)

( * ) Notice: Subject to any disclaimer, the term of this patent is extended or adjusted under 35 U.S.C. 154(b) by 88 days.

(21) Appl. No.: 11/066,149

(22) Filed: Feb. 25, 2005

(65) Prior Publication Data

US 2006/0193139 A1 Aug. 31, 2006

(51) Int. Cl.
*F21V 29/00* (2006.01)
*F21V 33/00* (2006.01)

(52) U.S. Cl. ..... 362/373; 362/294

(58) Field of Classification Search ..... 362/96, 362/294, 373, 234, 800
See application file for complete search history.

(56) References Cited

U.S. PATENT DOCUMENTS 3,180,981 A * 4/1965 Ulffers ..... 362/294
4,600,979 A * 7/1986 Fisher et al. ..... 362/373
5,099,399 A * 3/1992 Miller et al. ..... 362/294

FOREIGN PATENT DOCUMENTS

TW 568988 2/2004

* cited by examiner

*Primary Examiner*—Y. My Quach-Lee

(57) ABSTRACT

A heat dissipating apparatus for lighting utility includes a casing, a light-focusing unit, a light-reflecting unit, a heat-dissipating unit, a light generator, a wind generator, a cover and a circuit board. The heat-dissipating unit absorbs a heat generated from the light generator, the wind generator circulates air outside the casing and inside the casing, whereby the heat absorbed by the heat-dissipating unit is dissipated outside the casing.

18 Claims, 5 Drawing Sheets

HEAT DISSIPATING APPARATUS FOR LIGHTING UTILITY

BACKGROUND OF THE INVENTION

1. Field of the Invention

The present invention relates to a heat dissipating apparatus for a lighting utility, and more particularly to a heat dissipating apparatus for a lighting utility, which has versatile operation modes and efficient heat dissipation, whereby the lifetime of the lighting utility employing the same is enhanced.

2. Description of Prior Art

The light-emitting diodes (LEDs) are extensively applied to various applications including lighting utility. Therefore, the LEDs are developed to provide high efficient and high power ability. However, considerable heat is also generated in lighting application, especially when the LEDs are sealed in a closed casing. The performance and lifetime of LEDs are degraded when excessive heat cannot be dissipated.

To overcome above drawbacks, means for heat dissipation is provided on package or stage of the LEDs for removing heat from the LEDs. However, the heat removed from the LEDs still exists in the closed casing. The heat dissipation result is not satisfactory and the lifetime of LEDs is also degraded.

Taiwan patent publication No. 568988 discloses a heat-dissipating deflexion cap for a lamp and a fan behind the heat-dissipating cap. The fan drives air to flow through the deflexion cap for heat dissipation. However, the heat dissipation is not satisfactory and there is only one heat dissipation mode.

SUMMARY OF THE INVENTION

The present invention provides a heat dissipating apparatus for lighting utility, which has versatile operation modes and efficient heat dissipation, whereby the lifetime of the lighting utility employing the same is enhanced.

The present invention provides a heat dissipating apparatus for lighting utility. The heat dissipating apparatus comprises a casing with a bulge portion at front side thereof and the bulge portion comprising at least one vent hole communicated with a hollow of the casing; a light-reflecting unit arranged in the casing; a heat-dissipating unit arranged on the light-reflecting unit and comprising at least one contact section in contact with the casing; a light generator arranged on the heat-dissipating unit and corresponding to the light-reflecting unit; a wind generator arranged on the heat-dissipating unit; a cover arranged on the casing and a circuit board arranged in the casing. The heat-dissipating unit absorbs a heat generated from the light generator, the wind generator circulates air outside the casing and inside the casing, whereby the heat absorbed by the heat-dissipating unit is dissipated outside the casing.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
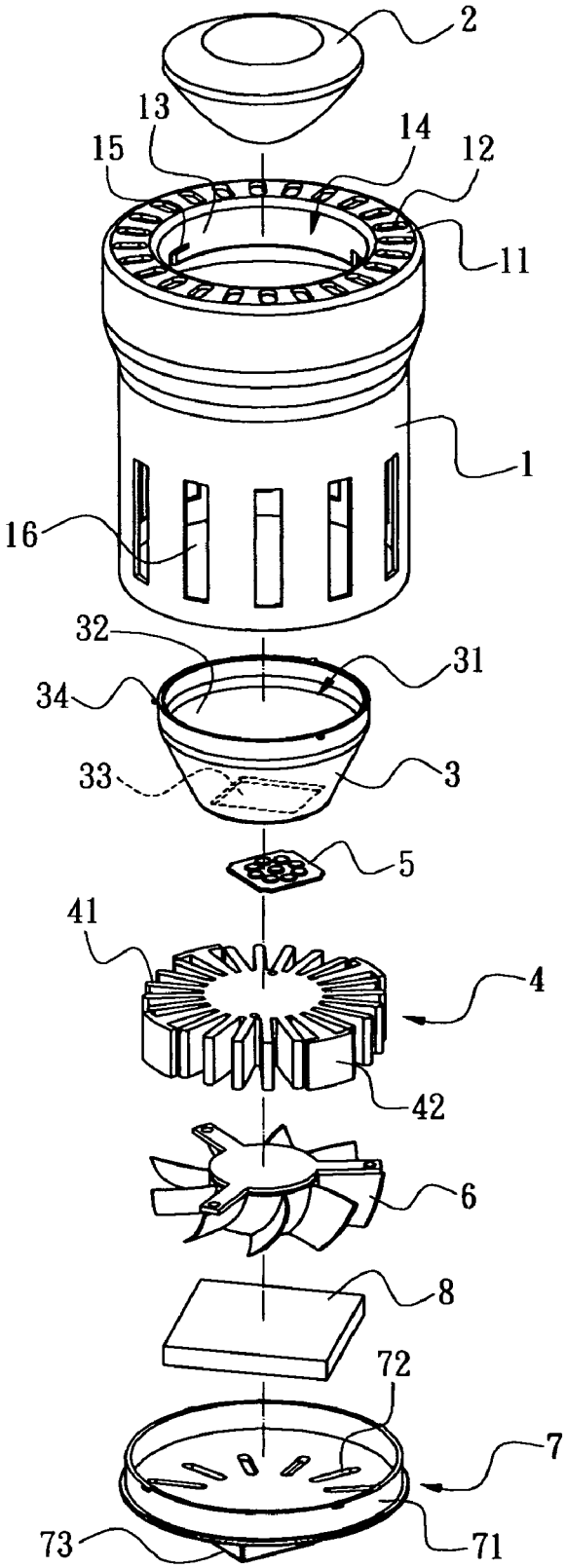
FIG. 1 is an exploded view of a lighting utility with the heat dissipating apparatus according to the present invention.
Figure 2:
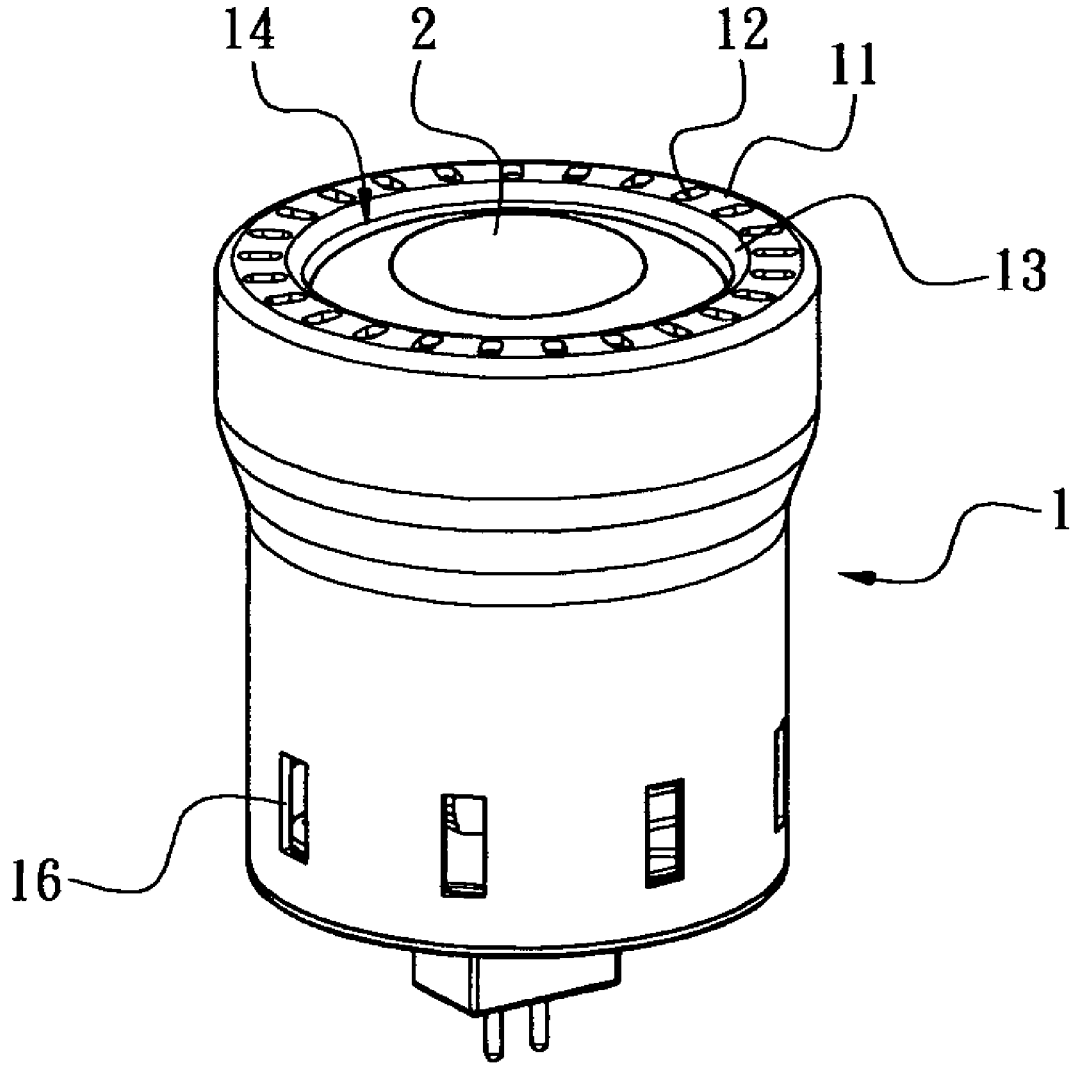
FIG. 2 is a perspective view of a lighting utility with the heat dissipating apparatus according to the present invention.

The heat dissipating apparatus for lighting utility according to the present invention comprises a casing 1, a light-focusing unit 2, a light-reflecting unit 3, a heat-dissipating unit 4, a light generator 5, a wind generator 6, a cover 7 and a circuit board 8.

The casing 1 is made of thermally conductive material and is of hollow shape. The casing 1 comprises a bulge portion 11 located at front side thereof and having at least one vent hole 12 communicating with hollow of the casing 1. The bulge portion 11 comprises an inner wall 13 to define an entrance 14 for assembling the light-reflecting unit 3. At least one clamping hole 15 is defined on the inner wall 13 for assembling the light-reflecting unit 3. A plurality of through holes 16 are defined on peripheral of the casing and a thermal radiating material is coated or sprayed on outer face of the casing 1 to enhance heat dissipating for the casing 1.

The light-focusing unit 2 is arranged on an opening 31 of the light-reflecting unit 3 and comprises a lens to focus the light from the light generator 5 to a place for illumination.

The light-reflecting unit 3 is placed on the inner wall 13 and the opening 31 is defined on one end of the light-reflecting unit 3 with a light-reflecting face 32 therein. The light-reflecting face 32 reflects light generated from the light generator 5 such that the light is reflected to the light-focusing unit 2. Moreover, an inlet 33 is defined at another end of the light-reflecting unit 3 and used for receiving the light generator 5. Moreover, a convex 34 is arranged on peripheral of the opening 31 and corresponding to the clamping hole 15.

The heat-dissipating unit 4 is made of thermally conductive metal and arranged on the inlet 33. The heat-dissipating unit 4 absorbs heat from the light generator 5 and conveys the heat to a plurality of fins 41 thereof for heat dissipation. At least one contact section 42 is arranged between the fins 41 and has close contact with the inner wall of the casing 1 to convey heat to the casing 1.

The light generator 5 is arranged on the heat-dissipating unit 4 and corresponding to the inlet 33. The light generator 5 is LED or light bulb.

The wind generator 6 is arranged on the same side of the heat-dissipating unit 4 and can be one of radial fan and axial fan to produce a wind to expel the heat out of the casing 1.

The cover 7 is arranged on bottom of the casing 1 and comprises a flange 71 with a plurality of slots 72 through which the heat is expelled out of casing 1 or external air enters the casing 1.

The circuit board 8 is placed in the casing 1 to provide electrical power to the light generator 5 and the wind generator 6.

Figure 3:
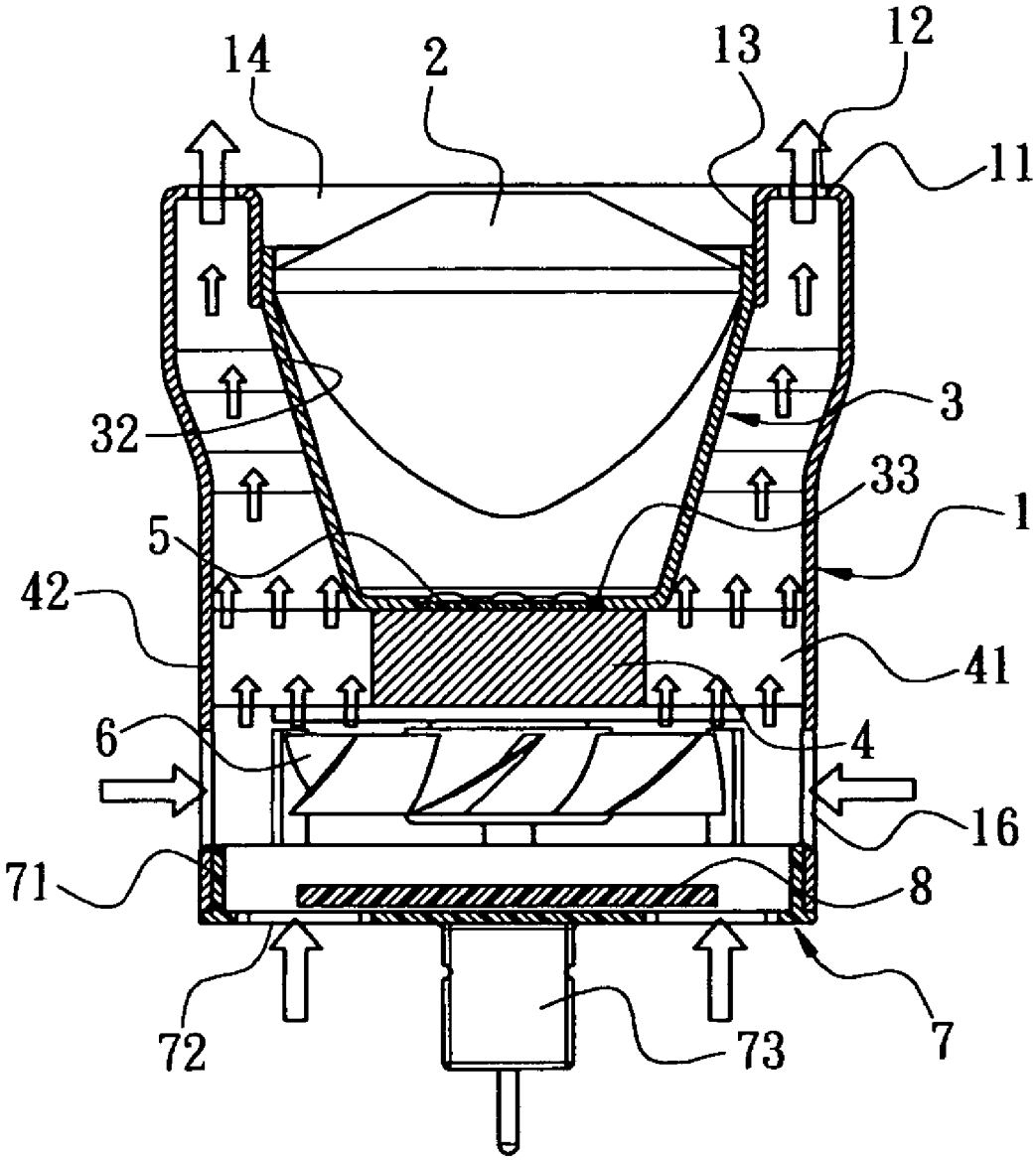
FIG. 3 shows the heat-dissipating operation of the heat dissipating apparatus for lighting utility according to the present invention.

FIG. 3 shows the heat-dissipating operation of the heat dissipating apparatus for lighting utility according to the present invention. When the light generator 5 is turned on, the light is projected, through the reflection of the light-reflecting face 32, to the light-focusing unit 2. After the light is focused by the light-focusing unit 2, the focused light is projected to a place for illumination. The heat generated by the light generator 5 is conveyed to the heat-dissipating unit 4 and then conveyed to the casing 1 through the contact section 42. The wind generator 6 is operated to draw external air to the heat-dissipating unit 4 through the through hole 16 and the slot 72. The heat is conveyed to top portion of the casing 1 and expelled through the vent hole 12. In this arrangement, the air flows from rear portion to front portion of the heat dissipating apparatus for lighting utility according to the present invention.

Moreover, the wind generator 6 can be reversely operated to draw external air to the heat-dissipating unit 4 through the vent hole 12. The heat of the heat-dissipating unit 4 is conveyed out of the casing 1 through the through holes 16 and the slots 72. In this arrangement, the air flows from front portion to rear portion of the heat dissipating apparatus for lighting utility according to the present invention.

Figure 4:
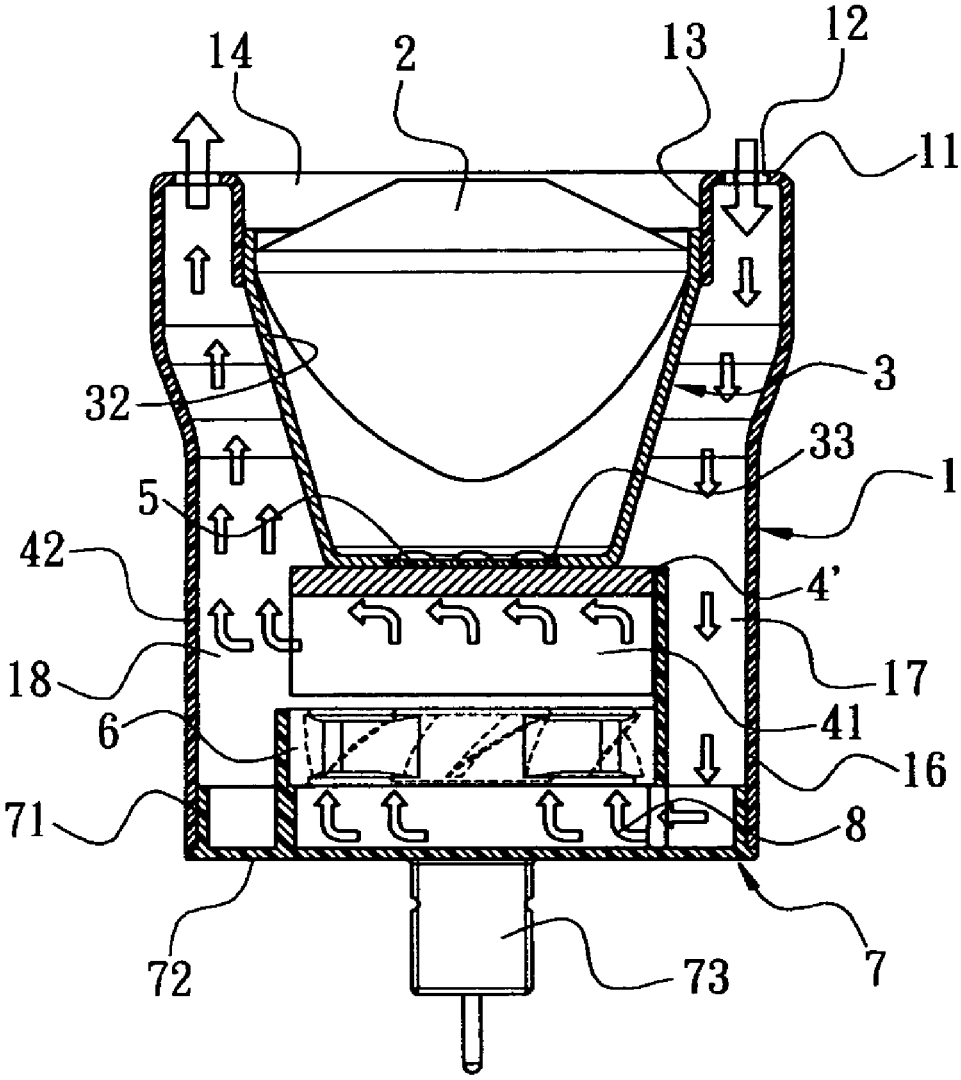
FIG. 4 shows another heat-dissipating operation of the heat dissipating apparatus for lighting utility according to the present invention.

FIG. 4 shows another heat-dissipating operation of the heat dissipating apparatus for lighting utility according to the present invention. In this example, the through holes 16 and the slots 72 are not provided. The heat-dissipating unit 4' is not in contact with the inner wall of the casing 1 and a passageway 17 is provided in the casing 1. When the wind generator 6 is operated, an external air is drawn into the passageway 17 through the vent hole 12 on one side and then flows to the heat-dissipating unit 4'. Afterward, the air flows out of the casing 1 through the passageway 18 and the vent hole 12 on another side. In this arrangement, the air flows in from front portion and then flows out from front portion of the heat dissipating apparatus.

Figure 5:
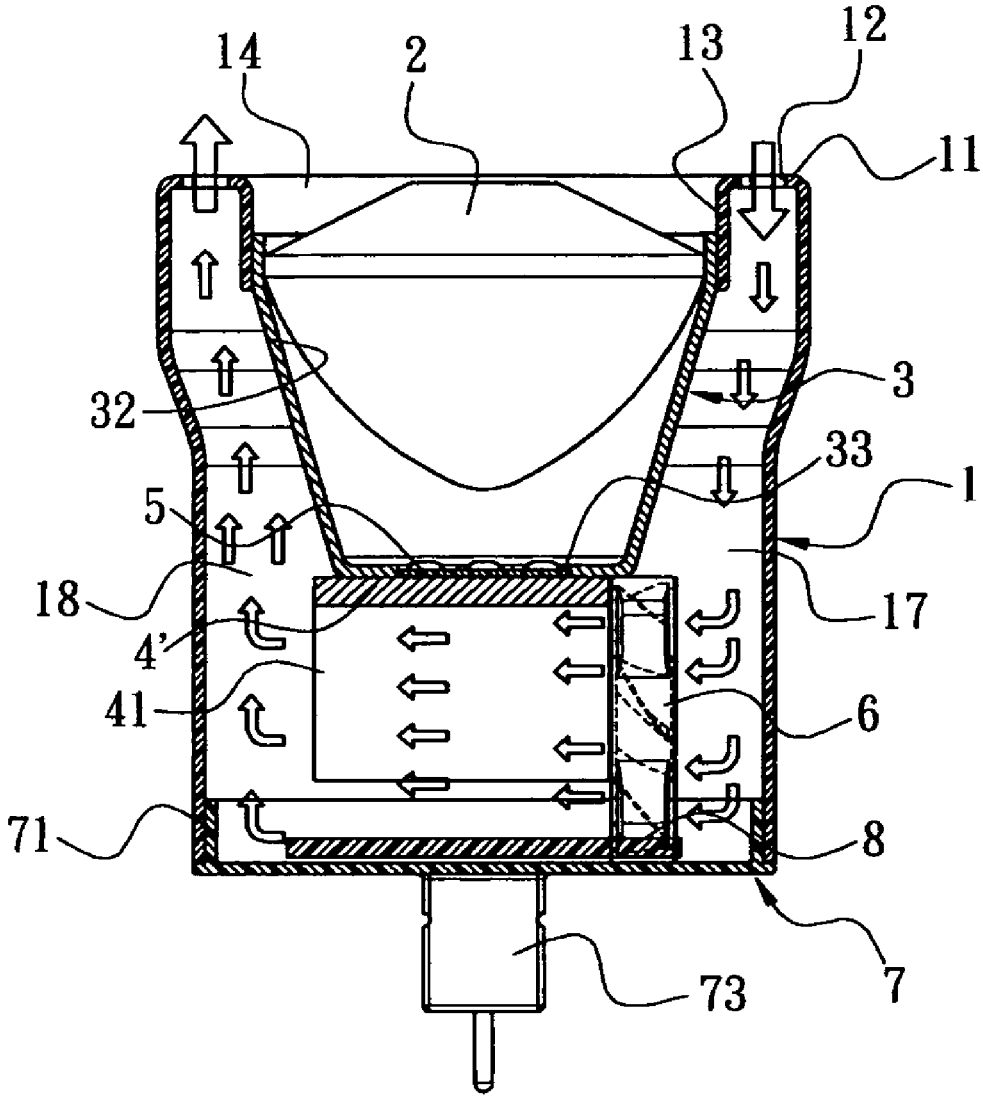
FIG. 5 shows still another heat-dissipating operation of the heat dissipating apparatus for lighting utility according to the present invention.

FIG. 5 shows still another heat-dissipating operation of the heat dissipating apparatus for lighting utility according to the present invention. In this example, the heat dissipating apparatus has similar elements as those shown in FIG. 4 except that the wind generator 6 is placed on one lateral side of the heat-dissipating unit 4'. When the wind generator 6 is operated, an external air is drawn into the passageway 17 through the vent hole 12 on one side and then flows to the heat-dissipating unit 4'. Afterward, the air flows out of the casing 1 through the passageway 18 and the vent hole 12 on another side. In this arrangement, the air flows in from front portion and then flows out from front portion of the heat dissipating apparatus.

Moreover, a power input 73 is arranged on one face of the cover 7, which can be plugged to a power socket.

Moreover, the heat-dissipating unit 4 can be one of thermal conductive plate, isothermal plate and heat pipe besides the fins.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A heat dissipating apparatus for lighting utility, comprising a casing comprising a bulge portion at front side thereof and the bulge portion comprising at least one vent hole communicating with a hollow of the casing;

a light-reflecting unit arranged in the casing;

a heat-dissipating unit arranged on the light-reflecting unit and comprising at least one contact section in contact with the casing;

a light generator arranged on the heat-dissipating unit and corresponding to the light-reflecting unit; and a wind generator arranged on the heat-dissipating unit, wherein the heat-dissipating unit absorbs a heat generated from the light generator, the wind generator circulates air outside the casing and inside the casing, whereby the heat absorbed by the heat-dissipating unit is dissipated outside the casing.

2. The heat dissipating apparatus as in claim 1, wherein the casing is made of thermally conductive material and comprises of a plurality of vent holes on the bulge portion positioned at an upper portion.

3. The heat dissipating apparatus as in claim 1, wherein the bulge portion comprises an inner wall to define an entrance.

4. The heat dissipating apparatus as in claim 3, wherein the inner wall comprises at least one clamping hole.

5. The heat dissipating apparatus as in claim 1, wherein the casing comprises a passageway therein.

6. The heat dissipating apparatus as in claim 1, wherein the light-reflecting unit comprises an opening defined on one side thereof and a light-reflecting face therein, an inlet is defined at another side of the light-reflecting unit and at least one convex is arranged on peripheral of the opening.

7. The heat dissipating apparatus as in claim 6, wherein a light-focusing unit is assembled to the opening.

8. The heat dissipating apparatus as in claim 7, wherein the light-focusing unit is a lens.

9. The heat dissipating apparatus as in claim 1, wherein the heat-dissipating unit is made of thermally conductive metal and composed of a plurality of fins.

10. The heat dissipating apparatus as in claim 1, wherein the heat-dissipating unit is one of thermal conductive plate, isothermal plate and heat pipe.

11. The heat dissipating apparatus as in claim 1, wherein the light generator is one of LED and light bulb.

12. The heat dissipating apparatus as in claim 1, further comprising a cover on a bottom of the casing.

13. The heat dissipating apparatus as in claim 12, wherein the cover comprises a flange in contact with the bottom of the casing and comprising a plurality of slots therein.

14. The heat dissipating apparatus as in claim 1, further comprising a power input arranged on one face of the cover.

15. The heat dissipating apparatus as in claim 1, wherein the wind generator is a fan.

16. The heat dissipating apparatus as in claim 15, wherein the wind generator is arranged on one side of the heat-dissipating unit.

17. The heat dissipating apparatus as in claim 1, further comprising a circuit board.

18. The heat dissipating apparatus as in claim 1, wherein a thermal radiating material is coated or sprayed on outer face of the casing to enhance heat dissipating for the casing.

* * * * *